US005222423A

United States Patent [19]

Wadzinski

[11] Patent Number: 5,222,423

[45] Date of Patent: Jun. 29, 1993

[54] OVERLAP CAM

[75] Inventor: Michel J. Wadzinski, Appleton, Wis.

[73] Assignee: Appleton Papers Inc., Appleton, Wis.

[21] Appl. No.: 864,378

[22] Filed: Apr. 6, 1992

Related U.S. Application Data

[63] Continuation of Ser. No. 540,794, Jun. 20, 1991, abandoned.

[51] Int. Cl.[5] ..... B65H 29/68

[52] U.S. Cl. ..... 83/88; 271/182; 271/202; 271/216; 271/270

[58] Field of Search ..... 83/88; 271/182, 202, 271/216, 270

[56] References Cited

U.S. PATENT DOCUMENTS

| | | | |
|---|---|---|---|
| 3,507,489 | 4/1970 | Wilshin et al. | 271/202 X |
| 3,685,823 | 8/1972 | Chamber | 271/270 X |
| 4,040,617 | 8/1977 | Walkington | 271/202 X |
| 4,214,744 | 7/1980 | Evans | 271/216 X |
| 4,364,552 | 12/1982 | Besemann | 83/88 X |
| 4,919,027 | 4/1990 | Littleton | 271/182 X |
| 4,969,640 | 11/1990 | Littleton | 271/216 X |

*Primary Examiner*—Frank T. Yost
*Assistant Examiner*—Raymond D. Woods

[57] ABSTRACT

An overlap cam for use in a precision sheeting machine for preventing overlap marks on carbonless paper includes a predetermined outer radius, a predetermined relieved area and an outer circumferential surface, all dictated by various sheeter section operating speeds. At least one lobe projects from the relieved area out to the outer predetermined radius. Rotation of the overlap cam will enable the lobe to engage a clip of sheets traveling at high speed at a point displaced a predetermined distance from the leading edge of a clip for preventing compression of active CB and CF together during braking and thereby preventing an overlap mark from being formed on a previously decelerated clip while still performing braking action of a clip of sheets supplied to the overlap section of the sheeter.

16 Claims, 9 Drawing Sheets

FIG. 10
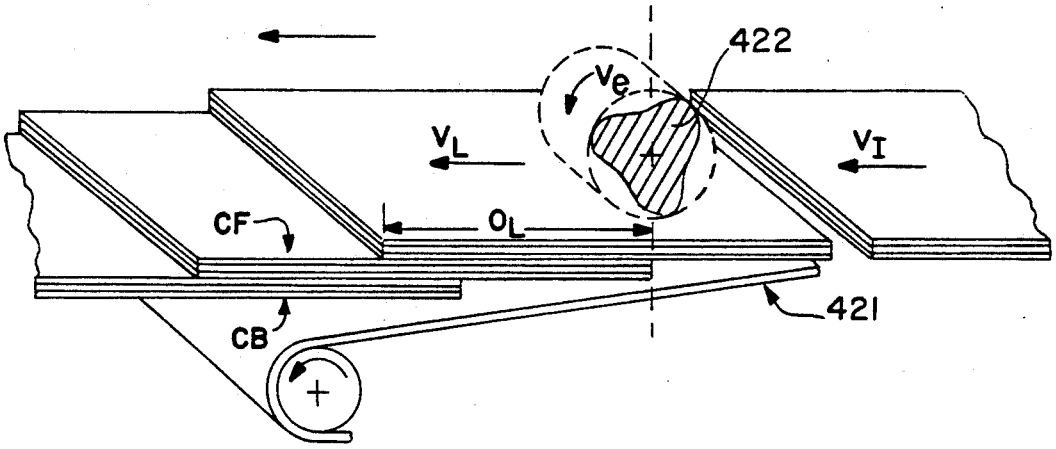
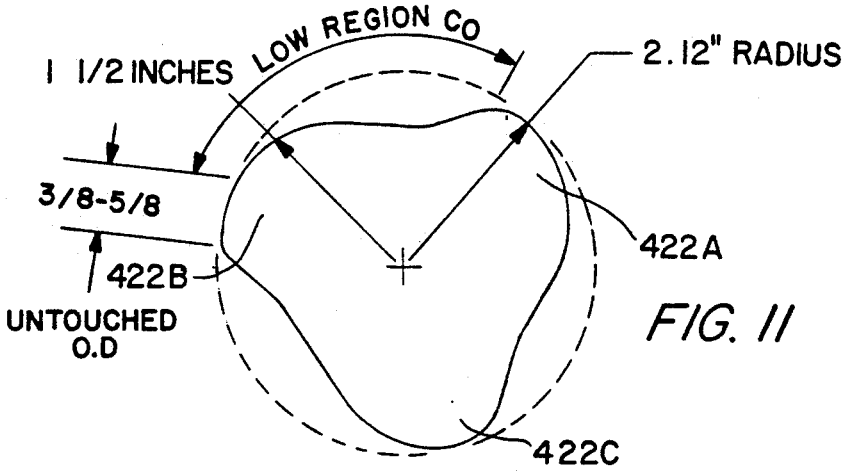
FIG. 11
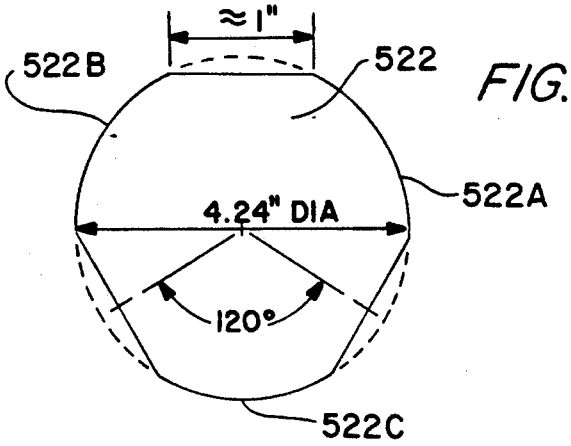
FIG. 12

OVERLAP CAM

This application is a continuation, of application Ser. No. 07/540,794 filed on Jun. 20, 1991, now abandoned.

BACKGROUND OF THE INVENTION

1. Field of the Invention

The present invention is directed to a cam member which includes at least one lobe. The cam member is used in a sheeter to eliminate overlap smudge while being able to operate the sheeter at a significant speed. This invention is designed for a sheeter, a machine which converts large rolls of paper (35" to 105" wide) into cutsize sheets, e.g. 8 ½"×11", etc.

2. Description of Background Art

Sheeters have been available for supplying a plurality of sheets to a processing station. Normally, the sheeters are used to handle bond paper at a typical operating speed approaching a thousand linear feet per minute.

It should be noted that the systems described in this document show only one of multiple repeated units that are added as the width of the sheeter increases to handle wider rolls of paper.

A problem is presented when carbonless paper is fed through a typical sheeter. The carbonless paper can only be operated at speeds approaching approximately 550 linear feet per minute. Overlap smudges occur when carbonless paper is used in a sheeter at higher speeds. Carbonless paper is a pressure-sensitive paper which will produce overlap smudges when CB material is rubbed under pressure against a CF surface. The amount of overlap roller frictional contact required to maintain sheet control for bond paper at high sheeter speeds will cause overlap roller smudge marks between CB and CF plies of carbonless paper form sets. Overlap smudges essentially ruin the product being handled by the sheeter. The overlapping operation used is standard on modern high speed sheeters to obtain higher operating speeds by virtue of providing a partial deceleration of sheets before the sheets are stacked into reams.

SUMMARY AND OBJECTS OF THE INVENTION

It is an object of the present invention to eliminate smudge marks on the CF ply of reverse sequence precollated form sets and CFB which are caused when the active CB material, from the CB surface and the cut edge of the CB sheet is rubbed against a CF sheet while the overlapped forms are compressed under a sheeter braking roll (overlap roller).

It is another object of the present invention to provide a sheeter which may handle carbonless paper at an extremely high rate of speed equal to that of bond paper without producing overlap smudges.

A further object of the present invention is to provide a novel cam design which serves to eliminate sheeter overlap smudges.

A still further object of the present invention is to provide a timing drive for imparting motion to the overlap cam for engaging a clip of sheets in a synchronized manner with a cutter on the sheeter.

A further object of this invention is to provide superior sheeter performance for all forms of sheeted paper (including bond) by virtue of improved directional sheet stability out of the overlap section. This claim is made because unlike the conventional overlap rollers which apply braking action to the front of high speed sheets, overlap cams apply braking force toward the rear of sheets, thus improving directional stability during braking.

A further object of this invention is to provide a mechanically simpler overlap cam system, fewer moving parts.

These and other objects of the present invention are achieved by providing an overlap cam for use in a sheet feeding machine for preventing overlap marks. The overlap cam includes a cam member having a predetermined radius. The cam member includes an outer circumferential surface. At least one lobe projects out to the outer predetermined radius and makes up the outer circumferential surface. The inner radius is designed to offer a relieved area that will not contact the sheets.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 10 is a schematic side view illustrating a fourth embodiment of an overlap cam according to the present invention engaging a clip of sheets;

FIG. 11 is a cross-sectional view of an overlap cam illustrated in FIG. 10;

FIG. 12 is a cross-sectional view of an overlap cam as illustrated in FIG. 9;

DESCRIPTION OF THE INVENTION

Smudge marks on the CF ply of a reverse sequence precollated set of forms and CFB are caused when CB material, activated by pressure and friction from a CB sheet is wiped against a CF sheet while the overlapped forms are compressed under a sheeter braking roll. Straight sequence precollated forms are sheeted to allow the forms to be used without being rearranged by the customer (CB, CFB, CF). Reversed sequence forms are sheeted so that a straight sequence form will be compiled after the sheets are printed (CF, CFB, CB). A ply is one sheet in a form. A clip, as defined hereinafter, is a stack of sheets of finished width and length containing a ply from each of the rolls being run through the sheeter. For example, a two-part form being produced in a six ply clip would contain three forms per clip.

Overlap smudge occurs on CFB sheets and precollated reverse sequence carbonless forms. The smudge marks develop at the position where the initial overlap roller induced frictional contact occurs between the bottom CB surface (facing down) or cut edge of the upper high speed clip and the top CF surface (facing up) of the lower decelerated clip.

The size and intensity of the overlapped smudge mark can be influenced by modifying the overlap section of the sheeter, particularly, the overlap rolls. In the overlap section, sheets traveling at a velocity greater than line speed are dropped onto a series of take-away belts which combine with the action of the kicker cams and the overlap roll to brake, tuck and overlap each clip while maintaining sheet alignment. It is the function of the overlap rollers to provide rapid deceleration of an incoming clip by compressing it against the previously decelerated clip and the take-away belts. The knockdown bar functions only to tuck the trailing edge of the decelerating clip under the leading edge of the next incoming clip.

Overlap smudge may be improved by either lowering the pressure of the overlap roll on the sheets while making modifications to improve sheet control or by reducing the amount of overlap of consecutive clips. The modifications are not satisfactory in view of demands for better quality, higher sheeter speeds and more trouble-free operation. The measurement of the overlap smudge mark of a conventional sheeter corresponds to the width of an overlap roll. The position of the smudge mark normally occurs a predetermined distance from the leading edge of the clip on the CF surface. The intensity of the mark increases with overlap roll pressure and sheeter speed. The smudge mark is found at a position where the conventional overlap roller first induces frictional contact between the two clips. The overlap length is determined by the ratio of line speed to take-away belt/overlap roll speed.

Figure 1:
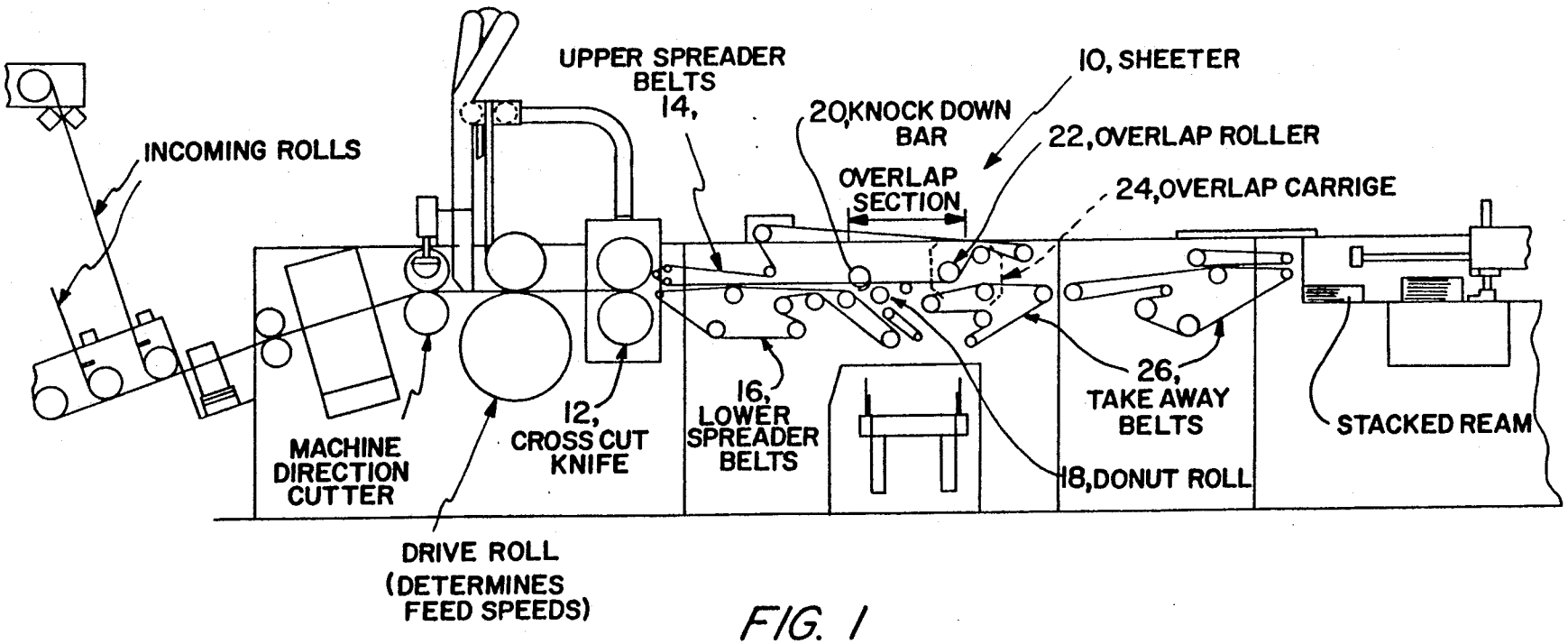
FIG. 1 is a schematic side view of a sheeter disposed adjacent to a cutter and including an overlap braking roller.

Referring to FIG. 1, a schematic side view of a sheeter 10 is set forth. Knives 12 engage a length of carbonless paper for severing the carbonless paper into a predetermined size. Thereafter, the clips are fed between upper spreader belts 14 and lower spreader belts 16. As the clips are conveyed along the upper and lower spreader belts 14, 16, they are engaged by a donut roll 18 and a knockdown bar 20. A take-away belt(s) 26 is provided for supporting overlapped clips of carbonless paper while carrying overlapped clips away from spreader belts 14 and 16. A conventional sheeter 10 will include an overlap braking roll 22 to permit the clips of carbonless paper to be overlapped one upon each other. The overlap braking roll 22 is necessary due to the fact that the upper spreader belt 14 and lower spreader belt 16 are conveying the stacks of carbonless paper at a greater speed relative to the take-away belt 26.

Figure 2:
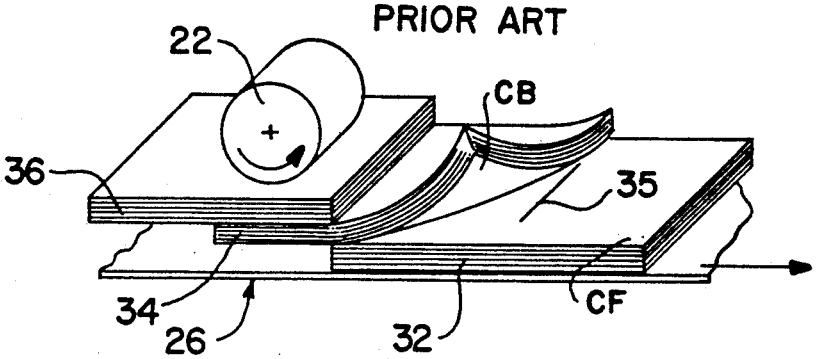
FIG. 2 PRIOR ART
FIG. 2 is a schematic view illustrating a conventional overlap braking roll, some dimensions have been exaggerated for clarity.
Figure 3:
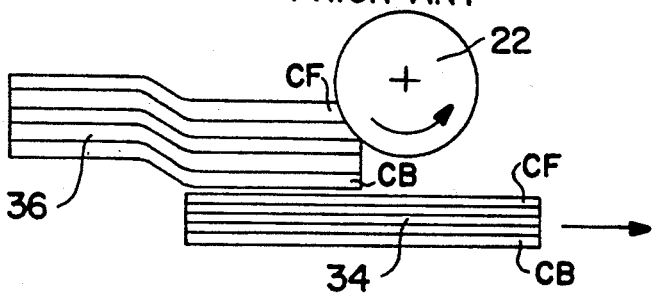
FIG. 3 PRIOR ART
FIG. 3 is a schematic side view of a conventional overlap braking roll, some dimensions have been exaggerated for clarity.
Figure 4:
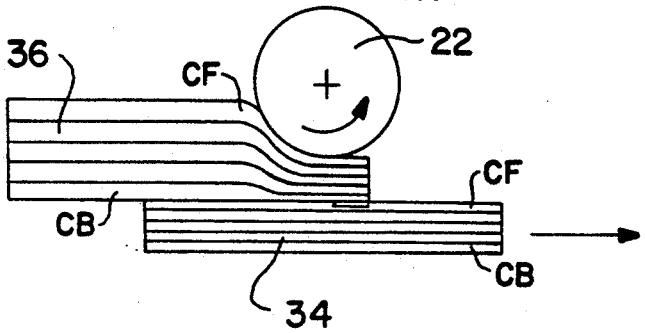
FIG. 4 PRIOR ART
FIG. 4 is a schematic side view of a conventional overlap braking roll engaging a clip of sheets, some dimensions have been exaggerated for clarity.

As illustrated in FIGS. 2–4, a problem results with respect to a conventional sheeter 10 utilizing a conventional overlap braking roll 22. As a clip 32 of carbonless paper 32 having an upper surface CF is transported along the sheeter by the take-away belts 26, a second clip 34 is deposited on top of the first clip 32. The second clip 34 includes a sheet CB disposed on the bottom thereof. A smudge mark 35 is formed on the upper sheet CF of the first clip 32 of carbonless paper by the frictional contact induced by the overlap roll of the CB sheet with the CF surface. A third clip 36 is illustrated as being positioned on top of the second clip 34.

As illustrated in FIGS. 3 and 4, the overlap braking roll 22 engages the third clip 36 to reduce the speed of the clip as it is deposited on top of the second clip 34. The overlap braking roll 22 compresses the third clip 36 so as to be engaged with the second clip 34. This compression of the third clip 36 together with the rubbing action of the active CB material on the sheet CB and/or cut edge of the third clip 36 relative to the CF ply on the second clip 34 actually causes the smudge to be positioned on the CF ply of the second clip 34.

Figure 5:
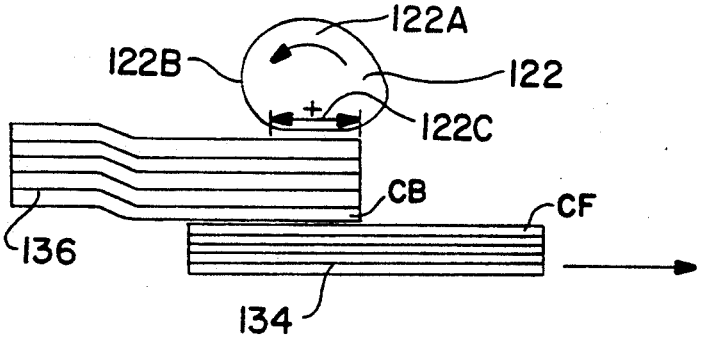
FIG. 5 is a schematic side view of an overlap cam according to a first embodiment of the present invention just prior to engagement with a clip of sheets, some dimensions have been exaggerated for clarity.
Figure 6:
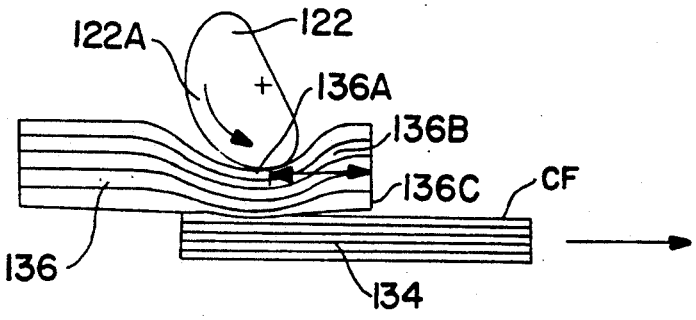
FIG. 6 is a schematic side view of an overlap cam according to the present invention engaging a clip of sheets, some dimensions have been exaggerated for clarity.

FIGS. 5 and 6 illustrate a first embodiment of an overlap cam according to the present invention. The overlap braking roll 122 includes a cam member having a predetermined radius r. A lobe 122A projects out to the outer circumferential surface 122B a distance equal to the length of the predetermined radius r. A first clip 134 of carbonless paper includes a CF ply disposed on the upper surface thereof. A second clip 136 of carbonless paper includes a CB ply on a lower surface thereof. As the second clip 136 is deposited on the first clip 134, a length 122C of the overlap cam 122 permits the second clip 136 to rest on the first clip 134 without any pressure being applied on or near the leading edge.

Thereafter, as illustrated in FIG. 6, the overlap cam 122 will continue to rotate in a timed sequence with the cutter knives 12 so that the lobe 122A compresses the second clip 136 to brake the speed of the second clip 136 so as to deposit the second clip 136 onto the first clip 134. By engaging a point 136A of the second clip 136 which is disposed a predetermined distance 136B from the leading edge 136C, a smudge mark is not formed on the CF ply of the first clip 134 by activated material from the cut edge of the CB contact surface.

Figure 7:
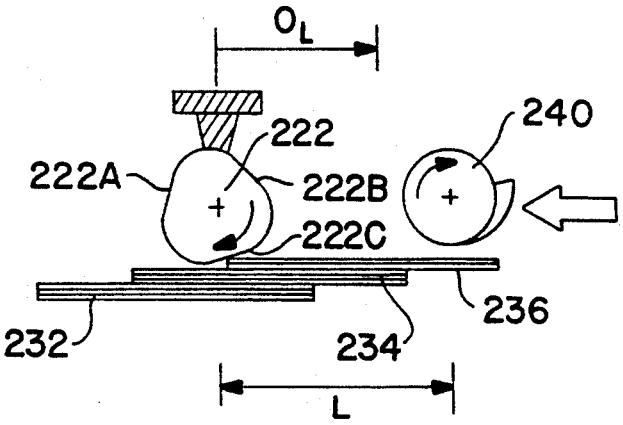
FIG. 7 is a schematic side view of a second embodiment of an overlap cam according to the present invention used in combination with a knockdown bar.

As illustrated in FIG. 7, a length L of a clip of carbonless paper 232, 234, 236 is predetermined by the knives of the cutter 12. An overlap cam 222 engages a clip 234 to brake the speed of the clip 234 relative to the clip 232. A knockdown bar 240 is employed together with the overlap cam 222. The knockdown bar 240 functions to tuck the trailing end of a decelerating clip downward so the next incoming clip can pass over the top of the decelerating clip without colliding. The overlap cam 222 includes a flat section 222A, 222B and 222C. An overlap length $O_L$ is determined by the speed of the clip 234 after it is decelerated and the speed of the clip 236 into the overlap section. In this way, one of the lobes on the cam 222 will engage the clip 236 at a distance from the leading edge. Thereafter, the clip 236 is compressed against the clip 234 to brake the action of the clip 236 being supplied thereto. However, no smudge occurs from activated CB material from the lead cut edge of the clip 236 on the clip 234 in view of the fact that the leading edge of the clip 236 is not compressed against the clip 234. A similar action occurs with regard to the next incoming clip relative to the clip 236.

Figure 8:
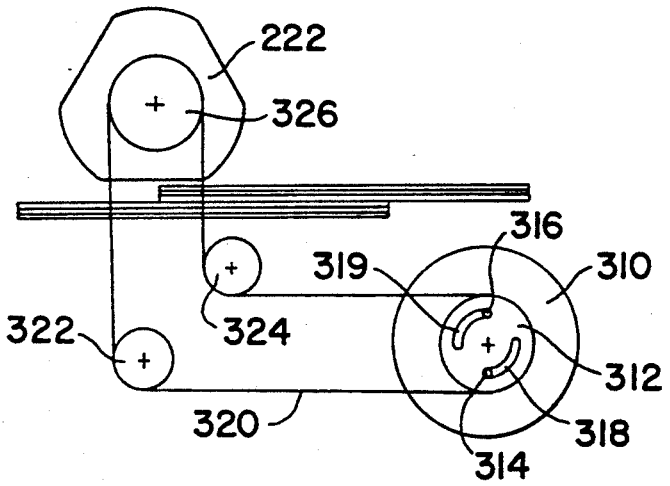
FIG. 8 is a schematic side view of an overlap cam according to a third embodiment of the present invention operatively connected to an overlap drive gear and timing belt.

FIG. 8 is a schematic view illustrating a timing mechanism for controlling the actuation of the cam 222. The drive roller 310 is connected by a timing belt(s) to the cross direction cutter knives 12 and the knockdown bars 240. The drive roller 310 is provided with an overlap cam timing roller 312. Adjustment bolts 314, 316 are provided in the tracks 318, 319 to permit an adjustment of the overlap cam timing gear 312 independent from other timing adjustments. A belt 320 travels over pulleys 322, 324 to engage a drive gear 326 affixed to the overlap cam 222. The overlap cam 222 is synchronized to work with the knives 12 of the cutter and the knockdown bars 240 so as to decelerate a clip of carbonless paper consisting of a predetermined number of plies at the proper time and position with respect to the knockdown bars 240.

Figure 9:
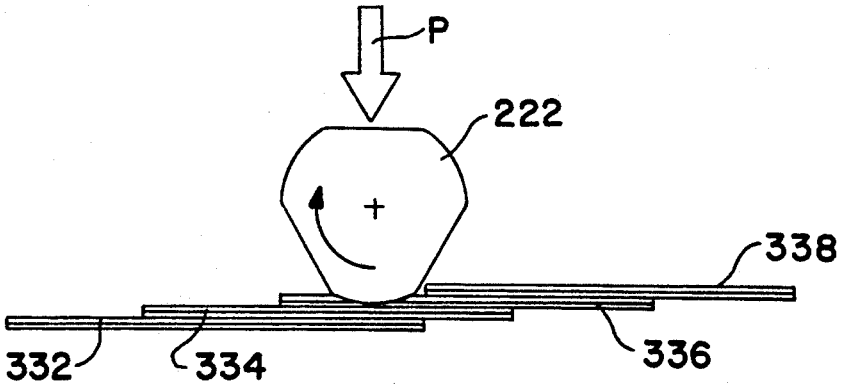
FIG. 9 is a schematic side view of an overlap cam according to the present invention engaging a clip of sheets.

FIG. 9 is a schematic view wherein the overlap cam 222 is illustrated as being positioned on a clip 336 of carbonless paper as it is overlapped or partially stacked on the lower clip 334. As the clips of carbonless paper are supplied by the upper spreader belts 14, a first clip 332 is deposited and a second clip 334 is positioned thereon. A third clip 336 is slowed and positioned on the top of the clip 334. Similarly, the speed of a fourth clip 338 is slowed by means of the overlap cam 222 as pressure in the direction of arrow P compresses the top clip onto a lower clip.

FIGS. 10 and 11 illustrate a fourth embodiment of the overlap cam according to the present invention. An overlap cam member 422 is illustrated having three lobes. The basic function of the overlap cam 422 is to allow the leading edge and the overlapped distance of each overlapping clip to pass underneath the cam without being compressed by the cam. After the leading edge and overlapped distance has passed under the overlap cam 422, the high regions of the cam brake the top clip of paper by compressing it against the take-away (low speed) belts 421. The cycle is then repeated by the following cam lobe. To construct an overlap cam which is less likely to cause a smudge mark from the CB ply to the CF ply due to surface frictional contact after the leading edge has passed thereover, the cam is designed to permit the leading edge to pass underneath. In addition, the entire overlap length of the lower clip is permitted to pass underneath the overlap cam without being compressed. This eliminates any braking action induced frictional CB to CF contact between two overlapping clips when the clips are slowed in the overlap section. Therefore, the possibility of making a smudge mark is eliminated.

The overlap cam 422 includes a first lobe 422A, a second lobe 422B and a third lobe 422C. The three lobes correspond to three cycles for every cam revolution. The number of cycles for lobes and the rotational speed of the cam must allow the cam to have the same cycle frequency as the sheeter cross direction knife 12 while having the outer circumferential surface speed match the take-away belt speed.

The overlap cam 422 may be constructed of a material that will permit the cam to be shaped as illustrated in FIGS. 10 and 11. It must also be strong enough to withstand the rotational speed required for the overlap system. Suitable materials would include steel, aluminum, other metals, metal alloys, rubber and plastic. A preferred material for constructing the cam is steel. Rubber cams have also been constructed.

The circumferential length of the cam cylinder that must be removed to allow no CB to CF frictional contact is dictated by the speed of the paper being fed into the sheeter, the speed of the take-away low speed belt 26, the surface speed of the cam and the speed of the paper being fed into the overlap section by belts 14 and 16. The speeds of the low speed belt and the feed speed of the paper into the sheeter determine the overlap length of paper.

The overlap length is defined below:

$$O_L = \left(1 - \frac{V_{Lo}}{V_p}\right)L$$

$O_{Lo}$ = Overlap length (feet)
$V_p$ = Paper feed speed into sheeter (fpm)
$V_L$ = Speed of low speed/take-away belt 26 (fpm)
$L$ = Length of sheets The fraction of circumferential length of the cam which will not compress a clip, its relieved portion, will be defined as follows:

$$f \geqq \frac{T_o}{T_{rev}} \text{ where } T_{rev} = \text{period of one cam cycle}$$

$$T_{rev} = \frac{(C_e)/n}{V_e}$$

$C_e$ = Cam cylinder circumference
$n$ = number of lobes (cycles) per cam revolution
$V_e$ = Surface speed of cam cylinder (maximum radius)
Since $V_e$ was designed to run at matched speed with the low speed belt then -continued $$V_e = V_L \text{ and } T_{rev} = \frac{C_e/n}{V_L}$$

and $$f \geqq \left( \frac{T_o}{\frac{C_e/n}{V_L}} \right)$$

The minimum amount of time required to avoid sliding CB against CF under pressure including the leading edge of each clip is then described as follows:

$$T_o \geqq \frac{O_L}{V_I - V_e} = \frac{O_L}{V_I - V_L}$$

$V_I$ = Speed of clips feeding into overlap sections (belts 14 and 16)

$V_L$ = Speed of low speed belts feeding out of overlap section (belts 26)

$V_I$ can be expressed in terms of $V_L$ or $V_P$ depending upon how the sheeter is geared.

f can then be expressed as $$f \geqq \frac{O_I}{(V_I - V_L)} / \left( \frac{C_e/n}{V_L} \right).$$

The rounded surfaces of the cam are designed to make the transition between the low and high surfaces smooth without disrupting the flow of paper prior to being decelerated by the high surface.

Figure 13A:
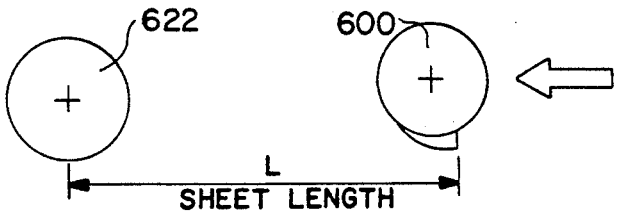
FIG. 13A PRIOR ART
FIG. 13A is a schematic side view of the positioning of a conventional overlap roller relative to a knockdown bar.

In order to compensate for the delay in braking action of the overlap cam as compared to a standard cylindrical overlap roller, the cam axle must be positioned closer to the knockdown fingers/bars 600 as illustrated in FIG. 13A. In addition, the overlap cam 422 must be operatively connected to a drive train which assures correct timing with the knives 12 and knockdown bars 20 and to permit for a simple overlap cam timing adjustment.

In order to eliminate the need for installing different diameter cams for different lengths of sheet clips, the speed of the take-away belt section is changed to allow the cam to turn at different rpms for different length sheets while matching the outermost cam surface speed to the take-away belt(s) speed.

By changing the take-away belt speed to match the outer circumferential surface speed of the cam for different length sheets, the overlap roll cam axle can remain at the same distance from the knockdown bar for any sheet length as shown below:

The non-overlapped length is defined as:

$$U_L = L - O_L \qquad \text{(See FIG. 13B)}$$

Since $U_L$ represents the length of clip available to the overlap cam to compress the incoming clip without creating a smudge mark on the clip below, then having the same length $U_L$ for different length sheets permits the cam to be positioned in one location with respect to the knockdown bars 600.

For two different sheet lengths $L_1$ and $L_2$, the knife rotational speed and the cam rotational speed will be changed by the same proportion since the two components are timed in sequence.

$$V_{e1} = \frac{L_1}{L_2} V_{e2}$$

and since $V_L$ is changed to match $V_e$ then $$V_{L1} = \frac{L_1}{L_2} V_{L2} \qquad \text{(equation 3)}$$

$V_L$ can also be expressed in terms of $U_L$ as follows:

$$U_L = L - \left(1 - \frac{V_{Lo}}{V_p}\right) L => U_L = \frac{V_{Lo}}{V_p} L$$

solving for $V_L$ gives $$V_L = \frac{U_L}{L} V_p^o \text{ and}$$

$$V_{L1} = \frac{U_{L1}}{L_1} V_p^o$$

$$V_{L2} = \frac{U_{L2}}{L_2} V_p^o \text{ therefore}$$

$$\frac{V_{L1}}{V_{L2}} = \frac{\frac{U_{L1} V_P^o}{L_1}}{\frac{U_{L2} V_p^o}{L_2}} => \frac{V_{L1}}{V_{L2}} = \frac{U_{L2}}{U_{L1}} \left( \frac{L_1}{L_2} \right) \text{since}$$

$$\frac{V_{L1}}{V_{L2}} = \frac{L_1}{L_2} \text{ by equation 3 then}$$

$$\frac{L_1}{L_2} = \frac{U_{L2}}{U_{L1}} \left( \frac{L_1}{L_2} \right) \text{giving}$$

$$U_{L2} = U_{L1}$$

for different length sheets.

By eliminating the need to reposition the overlap cam axle for different length sheets, the mechanical complexity of the sheeter is reduced, operation is simplified, and the sheeter can become more compact.

FIG. 12 illustrates the configuration of the embodiment of the overlap cam of FIGS. 8 and 9 wherein the overlap cam 522 includes three lobes 522A, 522B and 522C. Each lobe is separated by a flat area which would not engage a ply of paper as the overlap cam 522 is rotated.

Five principles are relied upon in the construction of the overlap cam system according to the present invention:

1. The non-overlap length remains constant for all cut size length changes;
2. The frequency of the overlap cam matches the frequency of the cut off knife;
3. The drive system for the overlap section must maintain a consistent overlap length;
4. The cam itself must be constructed to conform with the previously described equations which are dictated by the previously mentioned parameters; and
5. The spacial constraints of the sheeter and cams must be designed to allow the overlap cams to be positioned in a manner described previously.

As illustrated in FIG. 13A, the positioning of a conventional overlap cam 622 relative to a knockdown bar 600 is set forth. The distance between the overlap roller 622 relative to the knockdown bar 600 is determined by the sheet length L.

Figure 13B:
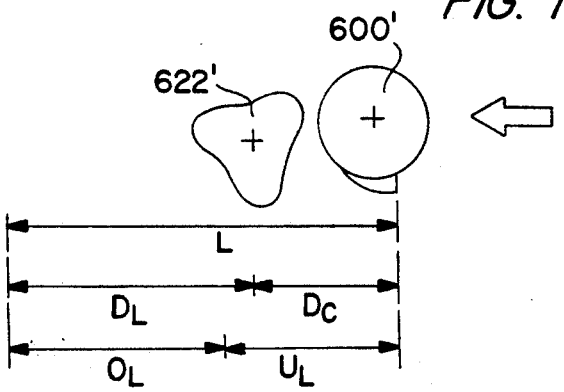
FIG. 13B is a schematic side view of the positioning of an overlap cam according to the present invention relative to a knockdown bar.

FIG. 13B illustrates the spacing of an overlap cam 622' relative to a knockdown bar 600'. The conventional spacing is set forth by the sheet length L. The spacing between the knockdown bar 600' relative to the overlap cam 622' is illustrated by the length $U_L$. The distance the overlap cam 622' has been adjusted relative to the normal spacing, as illustrated in FIG. 13A, is illustrated by the length $D_L$. The distance $D_L$ is greater than or equal to the distance $O_L$ wherein $O_L$ $$O_L \text{ is equal to } \left(1 - \frac{V_{Lo}}{V_p}\right) L \text{ and}$$

$$U_L \text{ is equal to } L - O_L$$

Figure 14A:
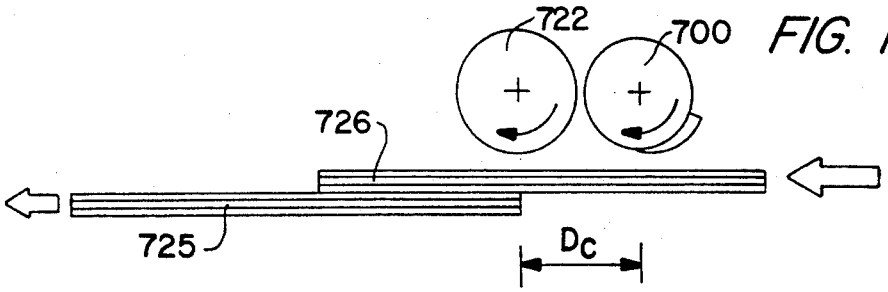
FIG. 14A is a schematic side view of a movable overlap roller in an off braking action relative to a knockdown bar.

FIG. 14A illustrates the positioning of a movable overlap roller 722 relative to a knockdown bar 700. In FIG. 14A, the movable overlap roller is disposed in an off position. A spacing between the overlap roller 722 relative to the knockdown bar 700 is set forth by the distance $D_C$. The distance $D_C$ is less than or equal to the distance $U_L$ as illustrated in FIG. 13B. The decelerated clip 725 is illustrated to the left in FIG. 14A. The unbraked clip 726 is illustrated directly below the overlap roller 722 and knockdown bar 700.

Figure 14B:
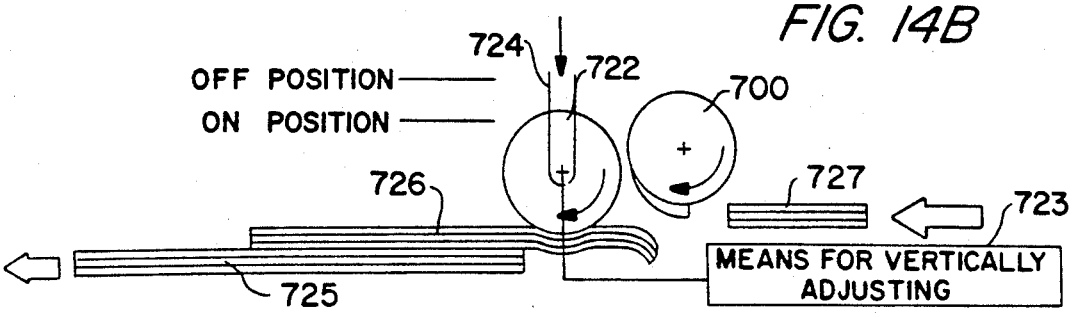
FIG. 14B is a schematic side view of a movable overlap roller in an on braking action relative to a knockdown bar.

FIG. 14B illustrates the movement of the overlap roller 722 to project downwardly by means 723 into engagement with the unbraked clip 726. This means 723 for vertically moving overlap roller 722 can be pistons, magnetic electric oscillators, servo motors, servo valves, electric vibrators or other known means for raising and lowering the overlap roller 22. In this manner, the unbraked clip 726 will be decelerated without the frictional contact between clips 725 and 726 that could result in a smudge mark. At the same time, another clip 727 is supplied to the work station. The movement of the overlap roller 722 may be accommodated by mounting means 724 of movable slots or cams or motorized actuation of the means 723 to permit the overlap roller to be selectively moved from an off position to an on position and returned to the off position.

Figure 15A:
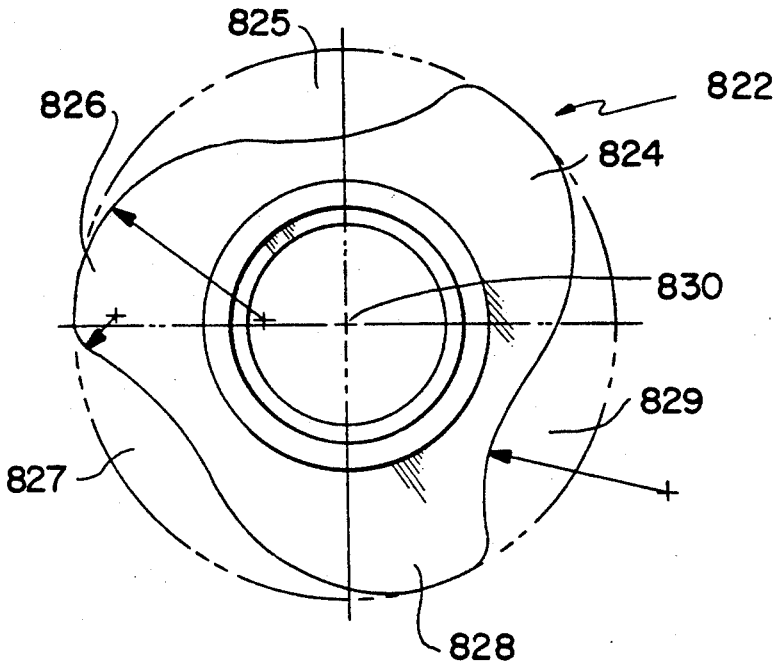
FIG. 15A is a side view of a fifth embodiment of an overlap cam according to the present invention.
Figure 15B:
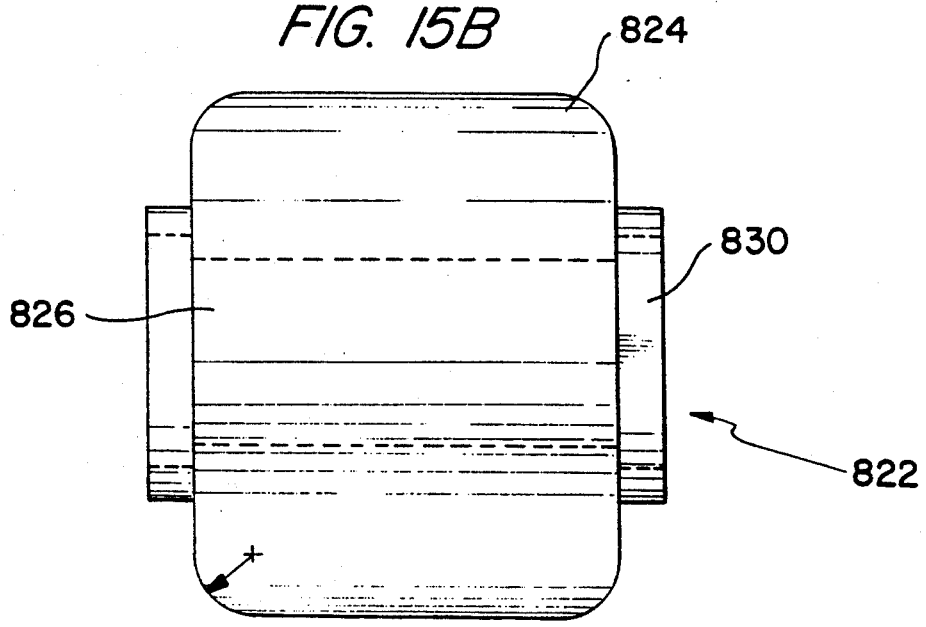
FIG. 15B is an elevational view of the overlap cam illustrated in FIG. 15A.

FIGS. 15A and 15B represent a fifth embodiment of the present invention and the best mode, wherein an overlap cam 822 includes a first lobe 824, a second lobe 826 and a third lobe 828. Each lobe is spaced apart relative to an adjacent lobe by means of an indented portion 825, 827 and 829, respectively. A central axis 830 permits rotational movement of the overlap cam 822.

Figure 16:
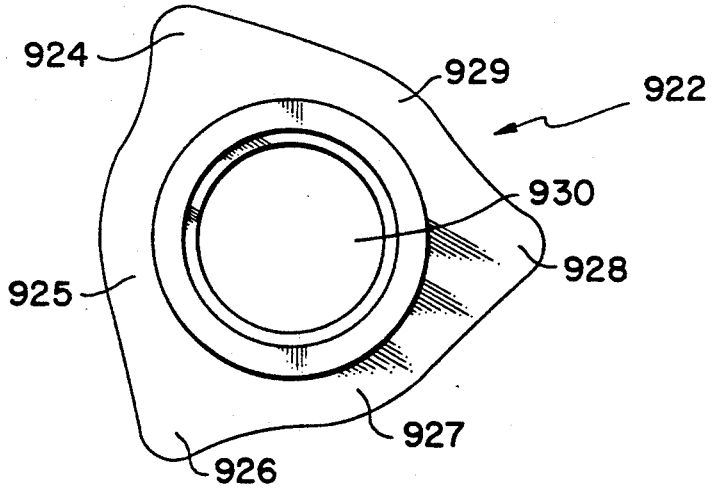
FIG. 16 is a side view illustrating a sixth embodiment of the present invention.

FIG. 16 illustrates a sixth embodiment of the present invention wherein an overlap cam 922 includes a first lobe 924, a second lobe 926 and a third lobe 928. Each lobe 924, 926 and 928 is spaced relative to each other by means of projecting portions 925, 927 and 929, respectively. The projecting portions 925, 927 and 929 project outwardly from an axle 930 to a distance which is less than the projection of the lobes 924, 926 and 928.

Figure 17:
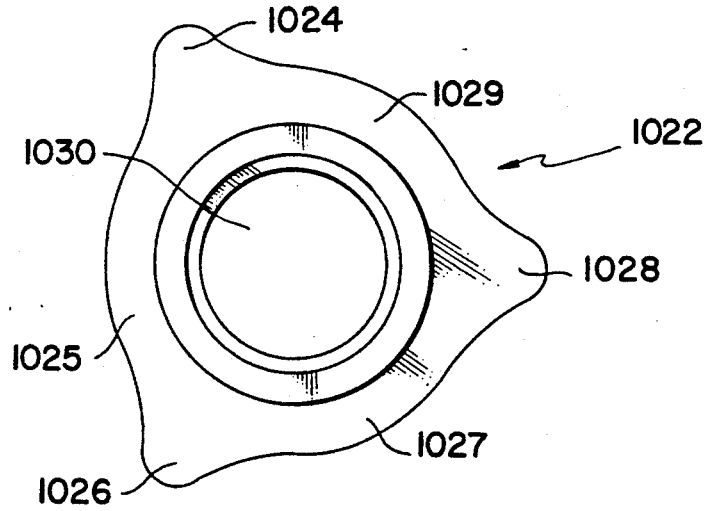
FIG. 17 is a side view illustrating a seventh embodiment of the present invention.

FIG. 17 illustrates a seventh embodiment of the present invention wherein an overlap cam 1022 includes a first lobe 1024, a second lobe 1026 and third lobe 1028. Each lobe is spaced relative to each other by means of a projecting portion 1025, 1027 and 1029, respectively. An axle 1030 is provided to permit rotation of the overlap cam 1022. The projections 1025, 1027 and 1029 project outwardly from the axle 1030 to a distance which is less the projection of the lobes 1024, 1026 and 1028.

Figure 18:
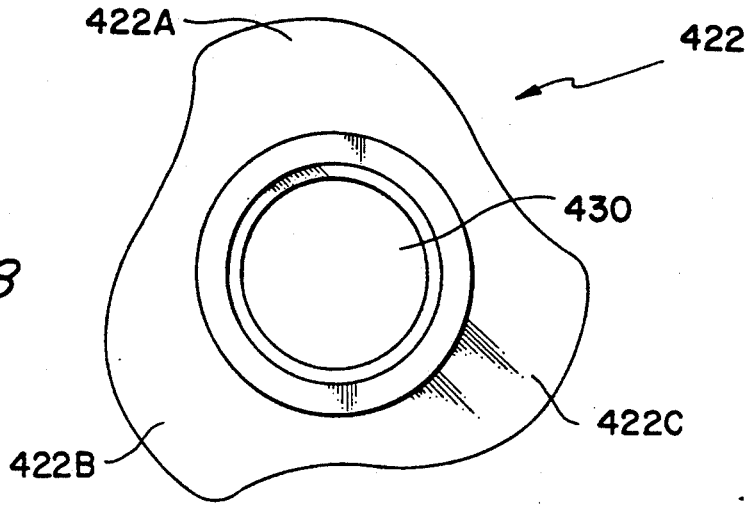
FIG. 18 is a side view illustrating in more detail the configuration of the overlap cam set forth in FIGS. 10 and 11.

FIG. 18 is a fourth embodiment of the present invention showing more clearly in detail the embodiment illustrated in FIGS. 10 and 11. An overlap cam 422 includes a first lobe 422A, a second lobe 422B and a third lobe 422C. An axle 430 is provided to permit rotation of the overlap cam 422.

Figure 19:
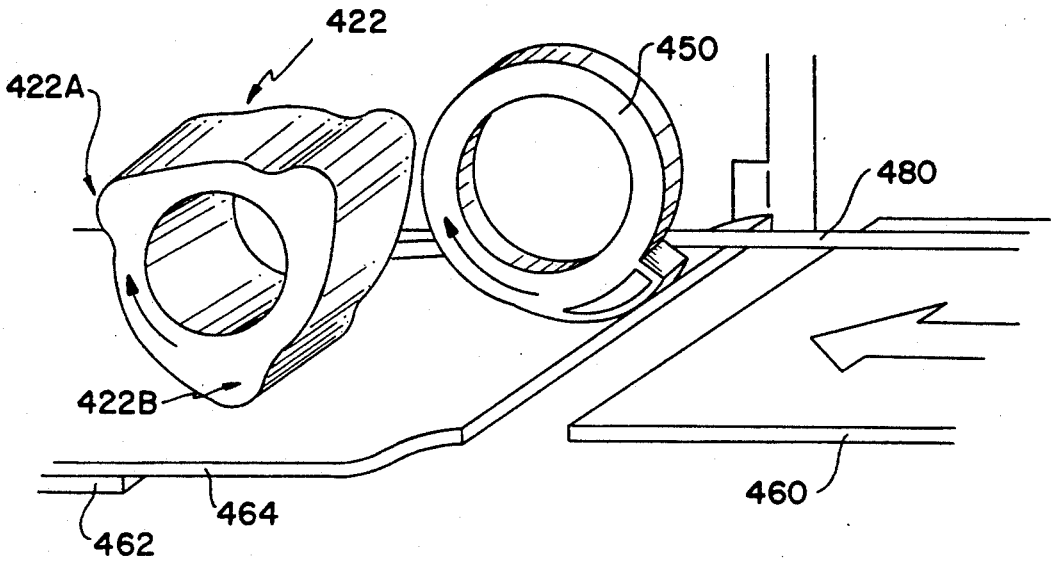
FIG. 19 is a schematic view illustrating the environment of the overlap cam relative to the knockdown bar.
Figure 20:
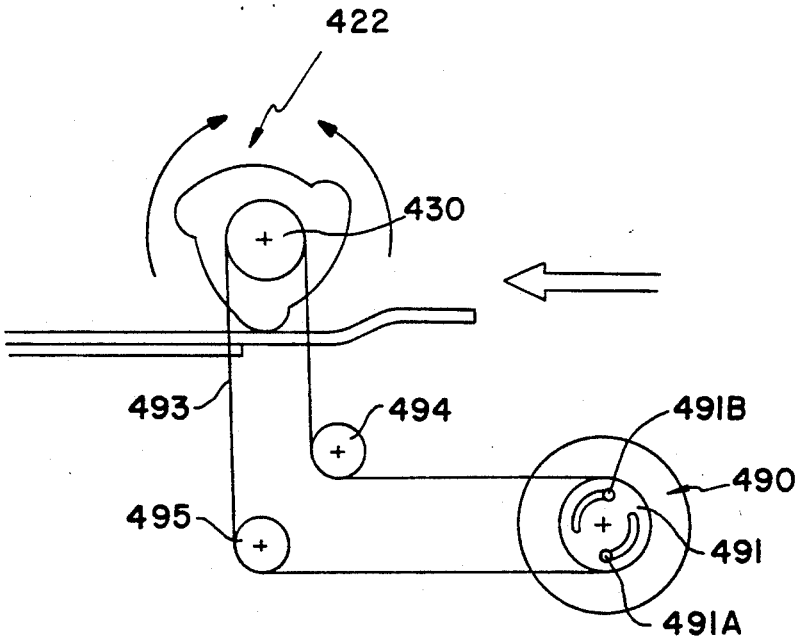
FIG. 20 is a schematic side view of an overlap cam according to the present invention operatively connected to an overlap drive gear via a timing belt.

FIGS. 19 and 20 illustrate the environment of the overlap cam 422 relative to a knockdown bar 450. A clip of sheets 460 is supplied from the cutter knives. An overlapped clip 462 has previously been braked by means of the overlap cam lobe 422A. An incoming clip 464 is positioned below the overlap cam 422 to be decelerated by lobe 422B. High speed tapes 480 (spreader belt 14) are provided adjacent to the knockdown bar 450 and guide the incoming clips. Only one spreader belt 14 and knockdown bar 20 are illustrated for clarity. Normally, each clip is handled by at least two spreader belts and knockdown bars.

FIG. 20 illustrates the overlap cam 422 which is operatively connected to a drive gear 490. An overlap cam timing device drive gear 491 is connected to the overlap drive gear 490. Adjustment bolts 491A, 491B are disposed within slots in the overlap cam timing device 491 to permit adjustment of the rotation of a drive belt 493 independently of drive gear 490. Guide pulleys 494, 495 are disposed to guide the drive belt 493 to rotate in unison with the overlap cam timing means 491 to impart rotation to the overlap axle drive gear 430 to rotate the overlap cam 422.

The present invention involves applying braking action to paper in sheeted clips while maintaining clip stability and alignment without compressing CF and CB surfaces including the leading CB edge, while the two surfaces are moving with differential speeds.

Another embodiment of this invention is to use a conventional style overlap roller to apply braking action without creating overlap smudge marks by virtue of moving the overlap roll axle so as to provide on/off style braking action to each incoming clip (See FIGS. 14A and 14B).

The basic difference between the cam system and this ON/OFF style roller system is the on/off braking action of the overlap cam is replaced by the ON/OFF style braking action of the overlap roller actuated by moving the overlap roller centerline up and down.

The ON/OFF motion of the cam axle must be synchronized with the cutter knives 12 and the knockdown bar 700 to provide the same duration of noncontact and contact time with each clip as an overlap cam would.

The axle itself may be moved in an up and down manner by a number of different methods that provide repeatable synchronized motion in a vertical plane.

The position of the roller axle from the knockdown bars Dc is also the same as that required for the overlap roll axle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An overlap cam for use in a precision sheeter machine for preventing overlap marks comprising:

an overlap cam having a predetermined radius, a predetermined length and an outer circumferential surface;

a single path along which a supplied clip of sheets move; and stopping means for rapidly decelerating the clip of sheets and thereafter quickly releasing the clip of sheets, the stopping means comprising at least one lobe rigidly disposed on said outer circumferential surface and projecting a distance equal to the length of said predetermined radius, rotation of said overlap cam will enable said lobe to engage the clip of sheets at a point displaced a predetermined distance from a leading edge of said clip without inducing frictional contact between adjacent surfaces on said clip and preventing an overlap mark from being formed on a previously handled clip of sheets while still performing a braking action of said clip of sheets supplied to said overlap cam, said lobe engaging the supplied clip of sheets for a given length which is less than half of an outer circumferential length of the overlap cam, said at least one lobe having rounded surfaces on leading and trailing ends thereof for enabling a smooth transition between a first supplied clip of sheets and a subsequently supplied clip of sheets for preventing disruption of a flow of clips of sheets.

2. An overlap cam according to claim 1, and further including a relieved section disposed on said outer circumferential surface of said overlap cam for enabling the subseqeuently supplied clip of sheets to pass thereunder as the subsequently supplied clip of sheets is supplied thereto and rotation of said overlap cam will permit said lobe to engage the subsequently supplied clip of sheets at a point displaced a predetermined distance from a leading edge of the previously handled clip of sheets.

3. An overlap cam according to claim 2, and further including at least two lobes disposed on said outer circumferential surface with flat sections disposed therebetween.

4. An overlap cam according to claim 2, and further including at least three lobes disposed on said outer circumferential surface with flat sections disposed therebetween.

5. An overlap cam according to claim 1, and further including an overlap cam timing means operatively connected to said overlap cam for imparting rotation to said overlap cam in synchronization with a cutting knife, a knockdown bar, a delivery speed and a take away speed of a clip of sheets.

6. An overlap cam according to claim 1, wherein at least two lobes are provided on the outer circumferential surface of said overlap cam each having a rounded surface for enabling a smooth transition between the first supplied clip of sheets and the subsequently supplied clip of sheets for preventing disruption of the flow of clips of sheets.

7. An overlap cam according to claim 1, wherein at least three lobes are provided on the outer circumferential surface of said overlap cam each having a rounded surface for enabling a smooth transition between the first supplied clip of sheets and the subsequently supplied clip of sheets for preventing disruption of the flow of clips of sheets.

8. An overlap cam according to claim 1, wherein the given length the lobe engages each clip of sheets is substantially less than half the outer circumferential length of the overlap cam.

9. An overlap cam according to claim 1, wherein the lobe engages one clip of sheets during deceleration without compressing a last previously handled clip of sheets, the last previously handled clip of sheets being adjacent the one clip of sheets being engaged by the lobe.

10. An overlap cam for use in a sheet feeding machine for preventing overlap marks comprising:

an overlap roller having a predetermined radius, a predetermined length, an outer circumferential surface and an axis of rotation;

means for mounting said overlap roller to be movable between an off position and an on position;

means for imparting movement to said overlap roller for selectively vertically reciprocating the axis of rotation to move the overlap roller between said on and off positions;

wherein selective movement of said overlap roller from said off position to said on position will enable said overlap roller to engage a subsequent clip without compressing previously handled clips of sheets and without inducing frictional contact between adjacent surfaces on said subsequent clip and preventing an overlap mark from being formed on the previously handled clip of sheets while still performing a braking action of the subsequent clip of sheets supplied to said overlap cam;

the overlap cam further comprising a knockdown bar, means for feeding supplied clips to the overlap roller and means for feeding the supplied clips from the overlap roller, the means for feeding clips from the overlap roller having a feeding speed $V_L$, the means for feeding clips to the overlap roller having a feeding speed Vp° wherein Vp° is greater than $V_L$, the knockdown bar being positioned upstream of said overlap roller relative to a feed direction of the supplied clips by a distance which is less than or equal to a length L of one of the supplied clips minus an overlap distance $O_L$ wherein $O_L$ is defined by the following equation:

$$O_L = \left(1 - \frac{V_L}{V_P}\right)L$$

11. An overlap cam according to claim 10, wherein the feeding speed $V_L$ of the means for feeding clips from the overlap roller is a desired speed to which the supplied clips are braked by a braking action of the overlap roller.

12. An overlap cam for use in a precision sheeter machine for preventing overlap marks comprising:

an overlap cam having a predetermined radius, predetermined length and a circumference $C_c$;

at least one lobe disposed on the circumference of the overlap cam and projecting a distance equal to the length of said predetermined radius, n being a number of the at least one lobe;

first means for feeding clips of sheets to the overlap cam, said first means for feeding having a feeding speed $V_F$; and second means for feeding the clips of sheets from the overlap cam, said second means for feeding having a feeding speed $V_L$;

wherein each of the clips of sheets will be engaged by a lobe of the overlap cam upon rotation of the overlap cam and upon feeding of clips by the first and second feeding means, the clips having an overlap distance $O_L$ between adjacent clips, the lobe engaging the clips at a point displaced a predetermined distance from a leading edge of a supplied clip without inducing frictional contact between adjacent surfaces on the clip and preventing an overlap mark from being formed on a previously handled clip of sheets while performing a braking action of the clip of sheets supplied to the overlap cam, said lobe engaging the supplied clip of sheets for a given length which is less than half of an outer circumferential length of the overlap cam to thereby rapidly decelerate the supplied clip of sheets, the overlap cam failing to engage the supplied clip for a fraction f of the circumference Ce being defined by the following equation:

$$f \geqq \frac{O_L}{(V_I - V_L)} / \left( \frac{C_e/n}{V_L} \right).$$

13. An overlap cam according to claim 12, further comprising a relieved section disposed on the circumference of said overlap cam for enabling a subsequent clip of sheets to pass thereunder as the subsequent clip of sheets is supplied thereto, the relieved section includes the fraction f, of the circumference rotation of the overlap cam permits the lobe to engage the subsequent clip of sheets at a point displaced a predetermined distance from a leading edge of the previously handled clip of sheets.

14. An overlap cam according to claim 13, wherein a plurality of lobes are provided around the circumference of the overlap cam and wherein generally flat sections are disposed between the lobes.

15. An overlap cam according to claim 12, wherein the at least one lobe includes a rounded surface for enabling a smooth transition between a first supplied clip of sheets and a subsequently supplied clip of sheets for preventing disruption of a flow of clips of sheets.

16. An overlap cam according to claim 12, wherein the at least one lobe engages the clip of sheets for a minimum time $T_o$, this time $T_o$ being defined by the following equation:

$$T_o \geqq \frac{O_L}{V_I - V_e} = \frac{O_L}{V_I - V_L}$$

wherein $V_c$ is a surface speed of rotation of the overlap cam.

* * * * *